United States Patent [19]

Farrington

[11] Patent Number: 4,869,391

[45] Date of Patent: Sep. 26, 1989

[54] PLASTIC LINER DISPENSING SYSTEM

[76] Inventor: Prince D. Farrington, 4915 Saratoga St., Millington, Tenn. 38053

[21] Appl. No.: 178,290

[22] Filed: Apr. 6, 1988

[51] Int. Cl.[4] ..... B65D 25/16

[52] U.S. Cl. ..... 220/407; 220/403; 220/404

[58] Field of Search ..... 220/400, 402, 403, 404, 220/407; 383/32, 104; 242/55.53

[56] References Cited

U.S. PATENT DOCUMENTS

| | | | |
|---|---|---|---|
| 1,701,097 | 2/1929 | Broderick . | |
| 2,079,177 | 5/1937 | Membrino . | |
| 2,650,016 | 8/1953 | McMillan . | |
| 2,817,474 | 12/1957 | Abramson . | |
| 3,094,810 | 6/1963 | Kalpin | 383/104 |
| 3,129,848 | 4/1964 | Canno . | |
| 3,300,082 | 1/1967 | Patterson | 220/404 |
| 3,392,825 | 7/1968 | Gale et al. | 220/404 |
| 3,442,437 | 5/1969 | Mann . | |
| 3,451,453 | 6/1969 | Heck | 220/407 X |
| 3,467,249 | 9/1969 | Calvert | 206/57 |
| 3,512,338 | 5/1970 | Nestler | 220/407 |
| 3,603,519 | 9/1971 | Brown | 242/55.53 |
| 3,637,276 | 1/1972 | Bump | 242/55.53 |
| 3,682,372 | 8/1972 | Rodley | 229/55 |
| 3,742,994 | 7/1973 | Pensak | 206/DIG. 30 |
| 3,762,599 | 10/1973 | Bourgeois | 220/403 |
| 3,800,503 | 4/1974 | Maki | 220/404 |
| 4,512,463 | 4/1985 | Ward | 206/216 |
| 4,721,226 | 1/1988 | Yurko | 220/407 |

FOREIGN PATENT DOCUMENTS

| | | | |
|---|---|---|---|
| 1204203 | 6/1967 | United Kingdom | 220/407 |

*Primary Examiner*—Stephen Marcus
*Assistant Examiner*—Christine A. Peterson
*Attorney, Agent, or Firm*—Foley & Lardner, Schwartz, Jeffery, Schwaab, Mack, Blumenthal & Evans

[57] ABSTRACT

A combination of a waste container and a stack of disposable plastic liners for use therein, each liner containing a cardboard insert. The inserts are dimensioned so as to frictionally engage the interior wall surface at or near the bottom of the tapered container and wedge the liners against the container. This frictional engagement prevents the stack of liners from spilling as the container is moved about. The frictional engagement is destroyed by pulling the insert upwardly and away from the interior of the container.

7 Claims, 2 Drawing Sheets

PLASTIC LINER DISPENSING SYSTEM

BACKGROUND OF THE INVENTION

Plastic bags made of polyethylene, PVC or other commonly used plastic or thermoplastic materials enjoy widespread use for the containment of trash and other waste. They are also widely used for storage and for carrying groceries and other items. Their low cost, strength, extreme light weight, ease of folding and imperviousness to water and other liquids makes them ideal for these purposes.

Plastic bags have no structural rigidity of their own. In use, therefore, especially for the containment of trash and other waste, they are ordinarily fitted within a can or container. Plastic bags are made in many standard sizes and, therefore, can be selected for closest fit with the desired container. A plastic bag is usually held within the container by lapping its open end over the rim of the container and tugging it downwardly. They are in this way frictionally fitted to the top of the container, but not to its bottom.

Plastic bags packaged for retail sale as container liners are usually joined end to end in a single continuous roll, with the liners being separated by perforated lines. These rolls are placed in paper or similar disposable cartons or boxes and extracted for use one at a time, for example, through a slot in the container. Their inherent slipperiness and flatness make it difficult to package them for sale in other ways, as by stacking them. Upon extraction from the container, they are separated from each other by pulling them apart along the perforated or serrated line.

Manufacturers strive to make plastic bags as thin as possible, in order to reduce the cost of materials and the weight of the bags themselves. Reducing the weight of each bag, however, makes a group of bags, if stacked, likely to topple over. Without special racks or other holders, therefore, it is not practical to stack folded plastic bags one atop another. The trade has developed a number of stacking arrangements and devices to remedy this, as for example, the "V" shaped stacking apparatus in U.S. Pat. No. 3,467,249 and the interlaced bag dispensing system of U.S. Pat. No. 3,392,825.

Extremely lightweight liner bags also tend to slip out of the container when it is turned on its side or upside down. Also, such thin plastic bags will break or tear at their bottoms when too great a loads placed in them.

SUMMARY OF THE INVENTION

The present invention is a novel combination of a container for waste and a plastic liner for insertion and use in the container. The liners are stacked or placed in the container for ready availability and sequential use. Liners may be purchased with the container in which they will be used, or purchased separately as when the original supply is exhausted.

The liners used in the present invention are packaged in bundles or stacks, and placed in the container for removal one by one. These plastic bags can be used as liners for any commercially available container. It is not necessary to use a specially designed container, nor are any special stacking methods or devices needed.

In one embodiment of the invention, each plastic liner includes therein a cardboard insert. Each insert is the same size as, or slightly larger than, the bottom of the container in which a stack of liners will be placed. An insert will ordinarily be circular for placement in a circularly-shaped container.

While inserts of corrugated cardboard have been found to work quite well, other materials such as plastics, also work satisfactorily. The material used must be stiff enough so that the insert can be wedged against the inside surface of the container. The taper of the container combined with the uniform diameters of the inserts enhances this wedging effect, assuring that unused liners stored at the bottom of the container will not fall out of the container if it is tipped on its side or turned over.

As liners are pulled out of the stack for use, it is necessary to overcome the snugness of fit produced by the wedging action between the insert and the container. Liners forming the lower portion of the stack are wedged most tightly. This loosening is achieved by lifting the insert upwardly within the container. A finger hole is provided in each insert for this purpose.

In a further embodiment of the invention, plastic liners may be dispensed from a roll of liners held in place at the bottom of the container on a rotating dowel arrangement. In still another embodiment, the liners themselves may be open for stacking one inside the other and pulling the stack down over the lip of the container.

It is an object of the invention to provide a waste containment and disposal apparatus which is conveniently and fixedly placed inside a container for serial use as container liners.

It is a further object of the invention to provide a container in combined use with a stack of disposable liners, in which the stack is held in frictional engagement with the container so as not to fall out of the container when it is tilted or turned upside down.

It is a further object of the invention to provide a dispensing system for plastic container liners, in which the liners are stored in pleated or folded array in the bottom of the container for future one-at-a-time use.

These and other objects of the invention will become more apparent upon reference to the following specification taken in connection with the accompanying drawings, wherein like reference numbers refer to the same parts, in which:

DETAILED DESCRIPTION OF THE PREFERRED EMBODIMENTS

Figure 1:
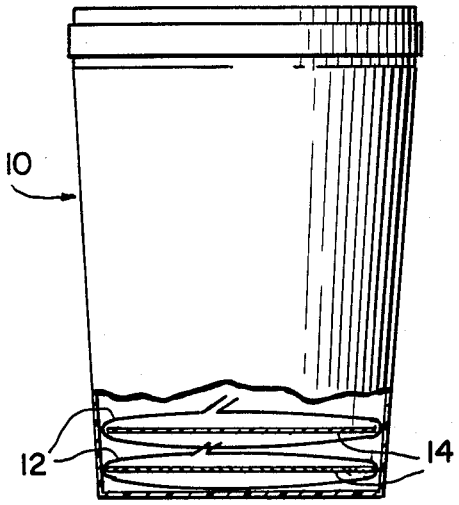
FIG. 1 is a side view of a waste container holding in its bottom a stack of plastic liners, each with an insert.

As illustrated in FIG. 1, a container 10, for garbage, waste or other storage and removal purposes, has in its bottom a stack of plastic liners 12. The container may be one that is commercially available, as, for example, a 22 gallon plastic or galvanized metal can, or a specially constructed container made of heavy cardboard or other suitable material.

Each plastic liner in the stack contains and is folded around an insert. For simplicity, only two liners and inserts are shown in FIG. 1. The thickness of each liner and the number of liners desired determines how many liners will be included in a package. It has proved commercially practical to include from 10 to 100 liners (and an equal number of inserts) in a stack.

The sides of container 10 are normally tapered and the liners so dimensioned that a snug fit between the insert and the inside of the container is provided. Inserts 14 are made of a material rigid enough to be tightly wedged into the bottom of the container, but which later can be released one at a time with minimal manual effort. Corrugated cardboard, plastic or similar rigid, lightweight and inexpensive materials can be used. The tapered shape of the containers also facilitates their stacking one partially inside another for shipment in large quantities to wholesalers and retailers.

Figure 4:
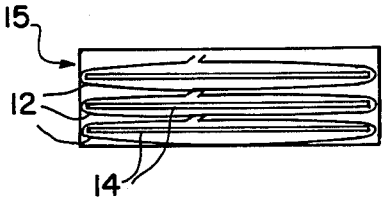
FIG. 4 is a side view of a stack of plastic liners, each containing a cardboard insert, according to one embodiment of the invention.
Figure 6:
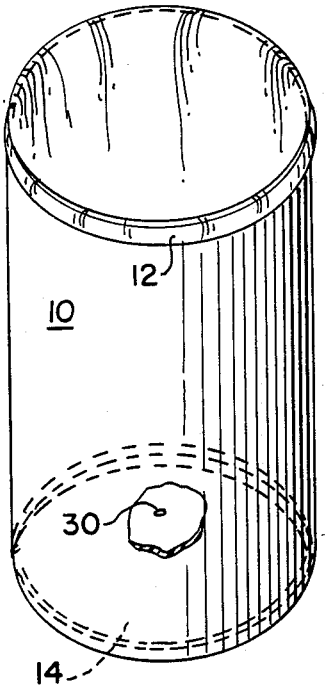
FIG. 6 is a perspective, partially fragmentary view of a container in which is positioned a disposable plastic liner and insert at the bottom thereof, the insert being formed with a finger release hole for loosening wedged inserts.

The stack of liners 15, as seen in FIG. 4, cannot slip out of the container even if the container is tipped over. Each liner 12 in the stack is caught or wedged against the interior container surface by its associated insert 14. The liners can be sequentially released from this frictional engagement by pulling upwardly on and releasing the insert, as shown in FIG. 6 and as will be hereinafter described.

Figure 2:
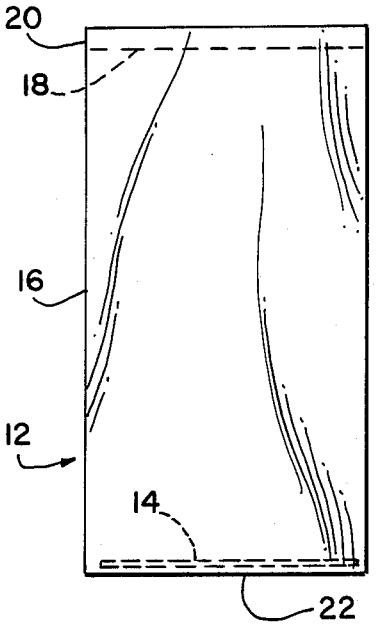
FIG. 2 is a side view of a single plastic liner for use in the invention.

FIG. 2 illustrates a plastic liner for use in the present invention. These liners can be manufactured for use with standard sized cans and containers, or may be made to fit specially sized containers. The length dimension 16 of each liner should enable it to extend a few inches above the rim 18 of the container in which it is inserted. This additional length 20 allows the open end of the liner to be pulled downwardly into a tight frictional fit with the rim of the container. The width 22 of the liner is larger than the interior of the container which it is to fill. The diameter of insert 14 is less than the diameter of the liner but substantially equal to the diameter of the container adjacent the bottom thereof, so as to provide the desired wedging effect.

Inserts 14, in addition to their function of wedging the liners inside the container, also provide a reinforced bottom for the liner when it is in or removed from the container. Paper and plastic bags with reinforced bottoms described in the prior art, for example, U.S. Pat. Nos. 1,701,097 and 2,650,016, depend on complicated insert positioning and unfolding arrangements, which this invention avoids.

Figure 3:
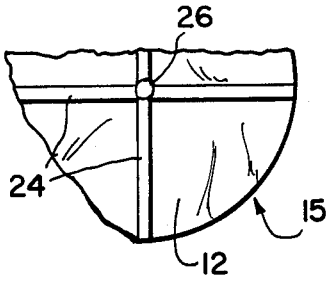
FIG. 3 is a fragmentary top view of a stack of plastic liners ready for placement in a container.

FIG. 3 is a fragmentary top view showing a stack 15 of liners and inserts, ready for placement in a container 10. This stack is tied by straps 24, which may b knotted or held by a pop-off closure 26. When the stack is placed in the container, straps 24 are severed or untied and removed from the stack.

FIG. 4 is a side view of a stack of folded liners, each containing an insert. Each liner can be folded in accordion-like fashion or otherwise in order to form a stack. The uppermost liner is pulled upwardly into position for use, in which position the top of the liner is wrapped over the top rim of the container. If tightly wedged, the insert is raised upwardly sufficiently to release it from the container wall so that the filled liner can be removed without having to overcome the wedging force.

Figure 5:
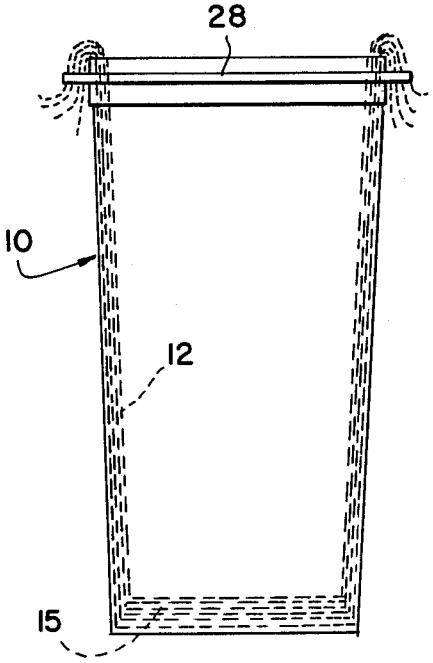
FIG. 5 is an embodiment of the invention in which the disposable liners are arrayed one inside another in opened form and pulled over the rim of the container.

In the embodiment shown in FIG. 5, a number of liners 12 are opened and placed one within the other in container 10. The innermost liner is filled first, followed by the filling of the next innermost liner and so forth until the supply is exhausted and replaced.

A tight fit between the open ends of the liners and the top of the container is obtained by selecting the proper sized liners and tugging their open ends down over the container rim. An insert (not shown) can be placed in the bottom of each liner. In this and other embodiments of the invention, the frictional fit between the liner and the rim of the container can be enhanced, if desired, by placing an elastic band or strip 28 over the liners and about the rim.

If desired, the container can be constructed of relatively inexpensive but sufficiently rigid cardboard, and the bags prepositioned in the container. In this manner, the entire assembly can be sold as a unit and the container simply discarded after the liners have been depleted. A throw-away assembly of this type would be particularly useful in hospitals or the like where sanitation is a prerequisite.

FIG. 6 illustrates the manner in which an insert may be removed from its frictional wedged engagement with the inside of the container. Each insert preferably includes a small hole 30 into which a user can insert his finger in order to pull the insert upwardly. This pulling will overcome the frictional engagement and permit easy removal of the liner when filled. The user would loosen the insert while the liner is empty.

FIG. 6 schematically shows a container 10 of uniform cross-section. Such containers work satisfactorily, although a tighter wedging effect is found when tapered containers are used. Containers of non-circular cross-sections can also be used, along with correspondingly shaped inserts.

Figure 7:
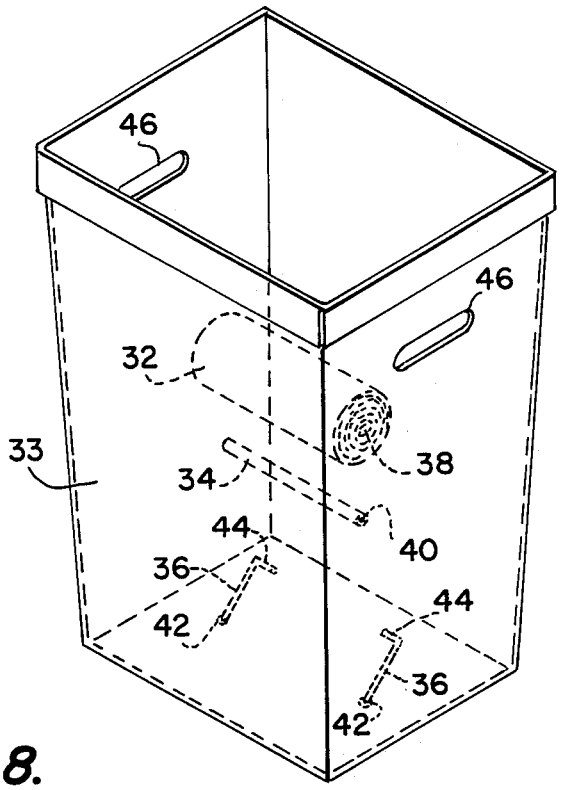
FIG. 7 is an exploded perspective view of an embodiment of the invention in which plastic liners are stored for use in a roll at the bottom of the container.
Figure 8:
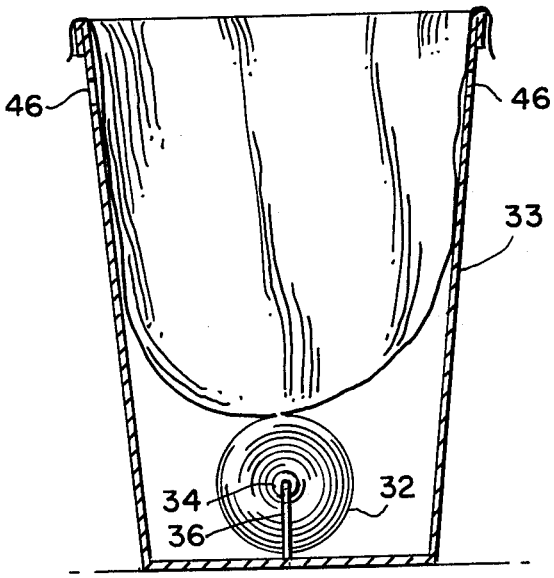
FIG. 8 is a side view of the container and roll of liners of FIG. 7.

FIG. 7 is an exploded view of another embodiment of the invention. A side view of this embodiment is shown in FIG. 8. A roll of liners 32 is held in place at the bottom of container 33 by means of a dowel 34 formed with holes 40 in each end thereof and fitted for retention by holders 36, which extend through openings 42 in the bottom wall of the container. The holders 36 are formed with inwardly directed ends 44. The liners are rolled in such a way that a hollow core 38 is provided through the center of the roll.

To mount the roll 32, dowel 34 is inserted through core 38. The ends 44 of the dowel holders 36 are then inserted into the holes 40 at each end of the dowel. The ends of the dowel which extend through holes 42 in the bottom wall of the container are secured in any suitable manner to the container, preferable to permit pivoting of the holder 36.

Container 33, in a commercial embodiment, was constructed of 300 pound test cardboard, but other materials could be used, as could cross-sections differing from that shown. Container 33 includes handgrips 46 for lifting and transporting it. These handgrips also allow air to circulate around the outside of the liner in use and thereby help avoid its adherence to the sides of the container.

Liners are removed from roll 32 one at a time. Each liner remains attached to the one immediately behind it in the roll until a filled container is removed. Removing a filled liner from the container causes the next liner to present itself closely adjacent the top of the container for convenient grasping. The filled and next liners can be separated by and pulled apart along a perforated line.

Although various embodiments of the invention have been described and illustrated, it is to be understood that modification may be made in its structure, form and arrangement of parts without departing from its spirit and scope. It should be understood that this intent is to cover all such modifications.

What is claimed is:

1. A waste containment and disposal apparatus including a container, a stack formed of alternately interposed plastic liners and rigid inserts, said stack being positioned in the bottom of the container, each insert being of substantially the same peripheral dimension as the interior of the container at or near its bottom, each insert and thus each associated liner of the stack being held in frictional wedged engagement with the interior of the container, whereby the stack is secured against displacement as the container is moved about and each liner is reinforced when the same is filled.

2. The waste containment and disposal system of claim 1, in which each plastic liner contains therein one insert.

3. The waste containment and disposal system of claim 2, in which the container is circularly cross-sectioned and tapered to have a smaller cross section at its bottom end.

4. The waste containment and disposal system of claim 1 in which the liners are arrayed one inside the other, the open ends of said liners being pulled over the lip of said container to achieve frictional contact between the open ends of the liners and the rim of the container.

5. The waste containment and disposal system of claim 1 in which the inserts are made of cardboard.

6. A waste containment and disposal apparatus including a container, a stack formed of alternately interposed plastic liners and rigid inserts, said stack being positioned in the bottom of the container, each insert being of substantially the same peripheral dimension as the interior of the container at or near its bottom, each insert and thus each associated liner of the stack being held in frictional wedged engagement with the interior of the container, each insert containing a fingersize hole facilitating the upward pulling of the insert to break the frictional engagement between the insert and the interior of the container, whereby the stack is secured against displacement as the container is moved about and each liner is reinforced when the same is filled.

7. A waste containment and disposal system including a container, said container being circular in cross-section and tapered to have a smaller cross-section at its bottom end, a stack formed of plastic liners and rigid cardboard inserts positioned in the bottom of said container, each plastic liner being folded and having positioned therein an insert, with each liner and associated insert being separate from the liner with insert positioned immediately adjacent thereto, each said insert having approximately the same peripheral dimension as the inside of the container at or near its bottom, each said insert contacting the interior of the container and thereby wedging the liner in which it is contained against said container, whereby the stack is secured against displacement as the container is moved about and each liner is reinforced when the same is filled.

* * * * *